United States Patent [19]

Potter

[11] Patent Number: 4,938,549

[45] Date of Patent: Jul. 3, 1990

[54] ROTARY FILE UNIT AND CABINET

[75] Inventor: Frank Potter, Syosset, N.Y.

[73] Assignee: Datum Filing Systems, Inc., Farmingdale, N.Y.

[21] Appl. No.: 431,396

[22] Filed: Nov. 3, 1989

[51] Int. Cl.[5] ..... A47B 88/00

[52] U.S. Cl. ..... 312/305; 312/252; 211/144; 211/163

[58] Field of Search ..... 312/305, 186, 252, 197, 312/202; 211/144, 163, 184

[56] References Cited

U.S. PATENT DOCUMENTS

| | | | |
|---|---|---|---|
| 247,160 | 9/1887 | Burnash | 312/305 |
| 1,386,500 | 8/1921 | Hile | 312/305 X |
| 2,596,316 | 5/1952 | White | 312/305 X |
| 3,160,282 | 12/1964 | Gunn | 21/184 |
| 3,203,748 | 8/1965 | Toms | 312/305 X |
| 3,341,266 | 9/1967 | Schecter et al. | 312/252 X |
| 3,993,375 | 11/1976 | Potter | 312/197 |
| 4,485,997 | 12/1984 | Potter | 312/252 X |
| 4,588,236 | 5/1986 | Potter | 312/271 X |
| 4,796,960 | 1/1989 | Candelas | 312/305 |

*Primary Examiner*—Joseph Falk

*Attorney, Agent, or Firm*—Nicholas J. Garofalo

[57] ABSTRACT

A rotary file unit provided with radially extending shelves and compartments for the storage of files, which unit may be used standing alone or housed within a cabinet having opposed access openings. A door unit is rotatable within the cabinet relative to the file unit to effect simultaneous opening or closing of both access openings. Divider elements are provided for dividing the spaces above the shelves into compartments of various widths; and backwall members are provided for varying the depths of the compartments.

3 Claims, 3 Drawing Sheets

FIG. 5
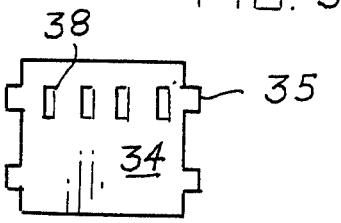
FIG. 3
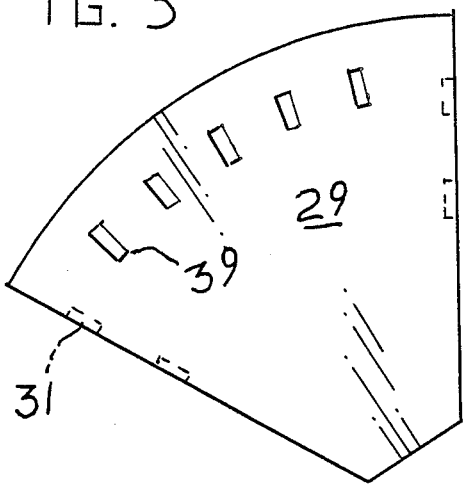
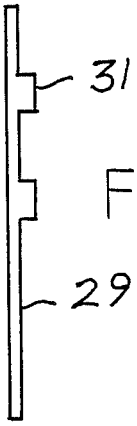
FIG. 4
FIG. 6
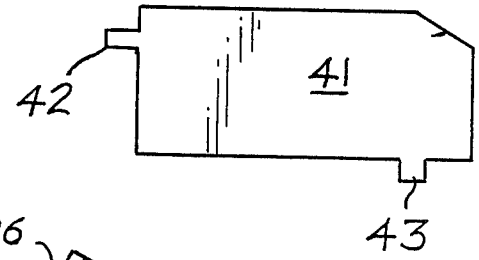
FIG. 2
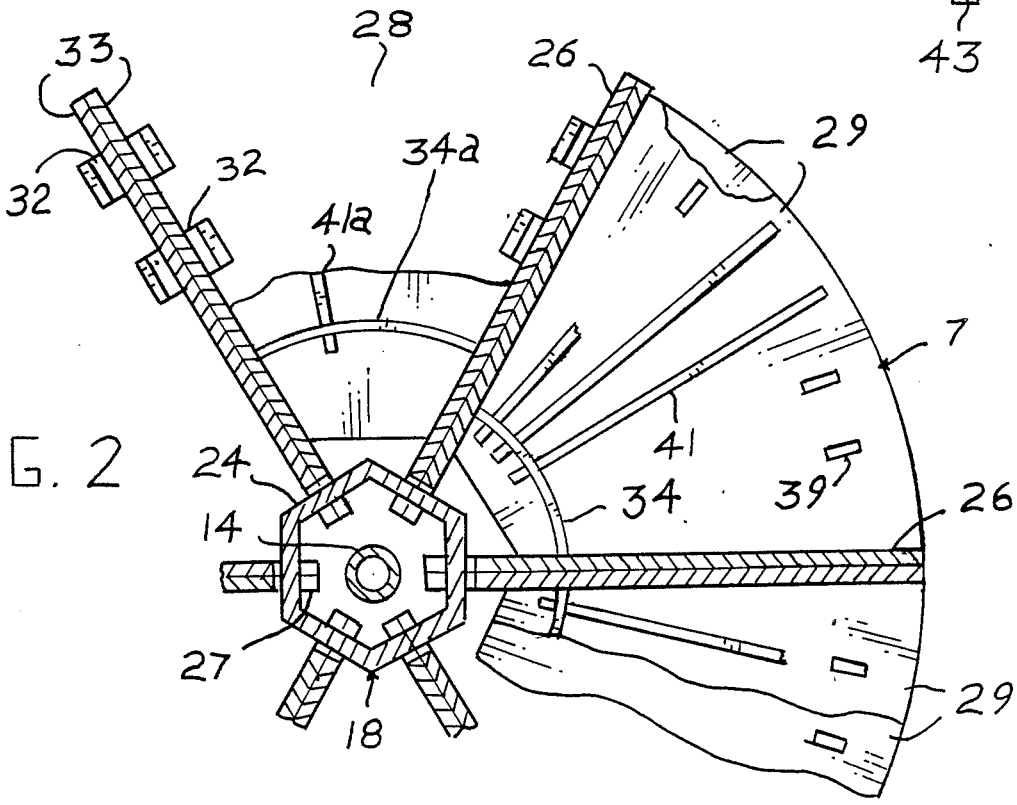

ROTARY FILE UNIT AND CABINET

BACKGROUND OF THE INVENTION

This invention is directed to a rotary file unit of a type which may be used standing alone, or it may be housed within a cabinet having opposed access openings which openings are subject to being closed over or opened by a door unit rotatable in the cabinet relative to the file unit.

A desirable feature of the file unit, whether it be used standing alone or as a component of a cabinet, is that it can be made to stand in any convenient area of a room. Further, when housed within a cabinet, several of the cabinets may be positioned in abutting side by side relation. When so employed, the several cabinets provide a continuous wall surface at opposite sides thereof while the doors are closed and, when the doors are opened, access to the file units is provided at opposite sides of the cabinets.

A further feature of the invention is that the file unit includes a file member having multiple shelves and compartments for the storage of file data; and the file member may be manually rotated to bring before the user any of the shelves and compartments.

Another feature of the invention is that, when the file unit is employed standing alone apart from a cabinet, the user may either rotate the file member or he may walk about it to select any particular shelf for use. Further, when so used apart from a cabinet, the file unit may be used by several workers, each standing about the periphery of the unit before a selected shelved.compartment.

A further feature of the invention lies in the nature of the shelves of the file unit. They may be manually positioned or repositioned at selectable levels; and associated components are provided whereby the space above a shelf may be readily subdivided into compartments of selectable widths and depths.

BRIEF SUMMARY OF THE INVENTION

The invention provides a rotary file unit having radially extending shelves and compartments for the storage of file data. The file unit may be used standing alone or housed within a cabinet. The cabinet is provided with opposed access openings permitting access from opposite sides of the cabinet to a file unit housed with the cabinet. A file member of the file unit is manually rotatable about a post to bring before a user any selected shelf. When the file unit is housed within a cabinet, a rotary dual door unit within the cabinet is rotatable about the post relative to the file unit to effect simultaneous closing of both access openings. Backwalls and compartment dividers are associated with the shelves, whereby the depth of the space of a shelf may be varied by the backwalls and the space may be varied by the dividers into compartments of selective widths and depths.

The foregoing structure of the invention, its features and advantages will become increasingly apparent as this specification unfolds in greater detail, and as it is read in conjunction with the accompanying drawing. However, it is to be expressly understood that the drawing is for purposes of illustration and description, and it is not to be construed as limiting the scope of the invention.

BRIEF DESCRIPTION OF THE DRAWING

In the accompanying drawing:

FIG. 2 is a cross-section on line 2—2 of FIG. 1;

FIG. 3 is a detail of a shelf element of the rotary file unit;

FIG. 4 is a side view of FIG. 3;

FIG. 5 is a detail of a backwall disposed at the rear of a shelf;

FIG. 6 is a detail of a divider element for dividing the area of a shelf into compartments;

DETAILED DESCRIPTION OF THE INVENTION

Figure 1:
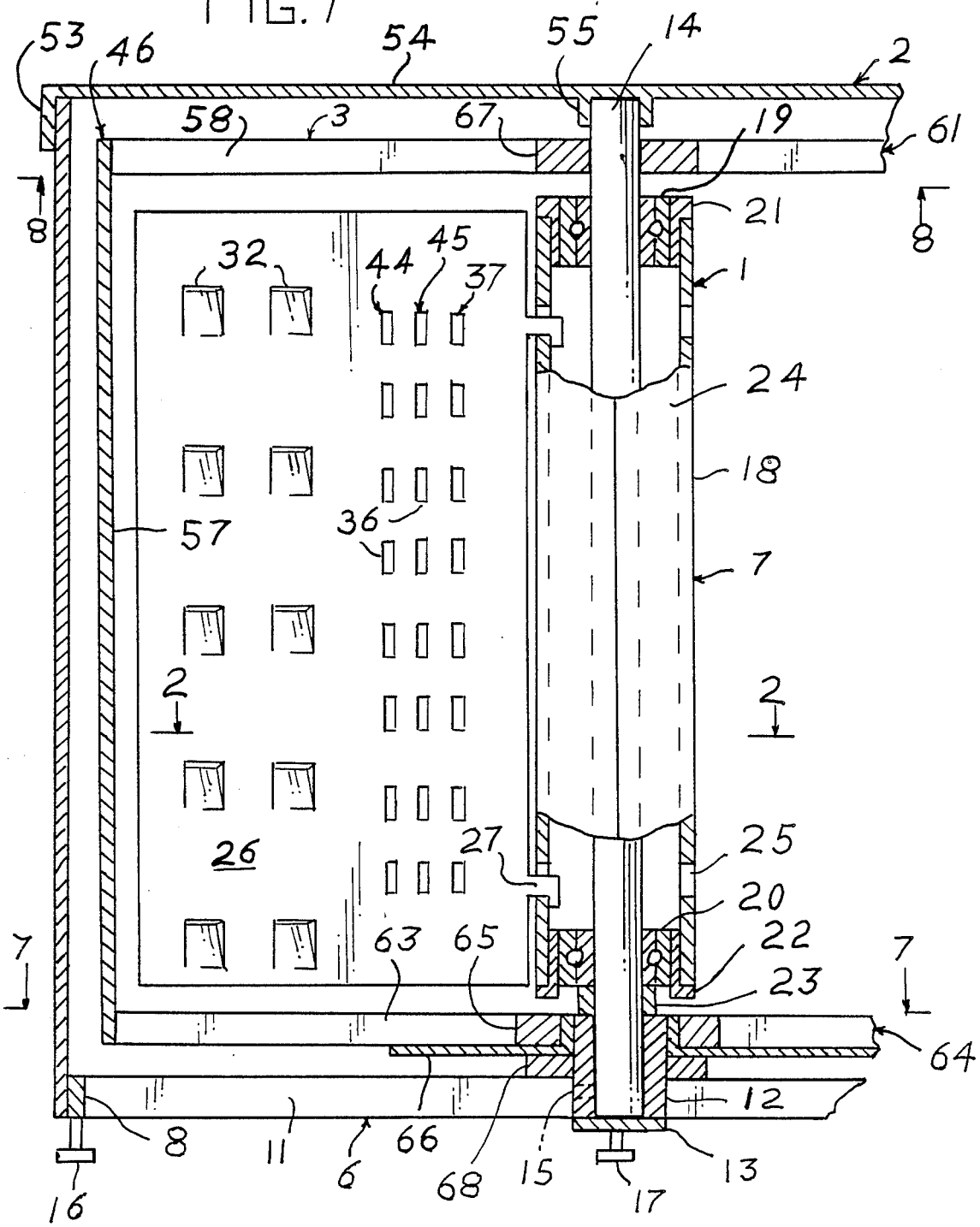
FIG. 1 is a section, drawn to a larger scale, on line 1—1 of FIG. 8.

For a more detailed understanding of the invention, it will now be described with reference to the accompanying drawing sufficiently and in such concise manner as to enable persons having ordinary skill in the art to understand, make and use the invention.

The drawing in which an embodiment of the invention is illustrated, discloses a rotary file unit, generally designated 1, standing within a cabinet 2. A door unit 3 is rotatable within the cabinet relative to opposed access openings 4, 5 to the file unit. The file unit includes a supporting stationary floor base 6 upon which a rotatable file member 7 of the file unit is mounted.

Figure 7:
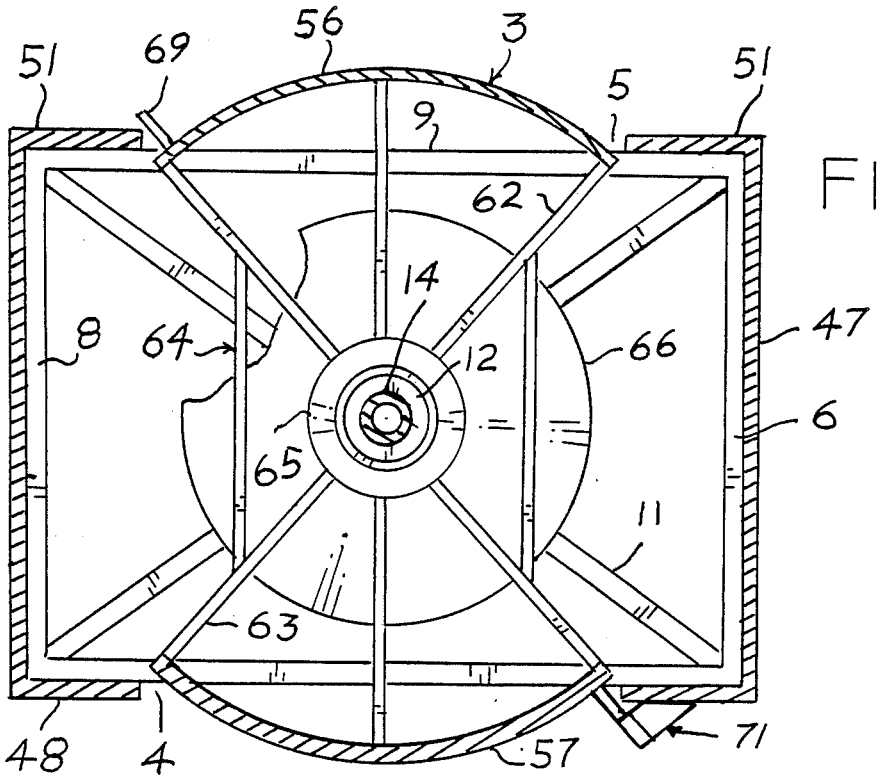
FIG. 7 is a section, on a smaller scale, on line 7—7 of FIG. 1.

The base has four sides 8, 9 (FIGS. 1, 7) at right angles to one another. Ribs 11 extending diagonally from the corners of the base are fixed at their inner ends to a central upstanding hub 12. A strap 13, fixed to the underside of the ribs, closes over an open bottom end of the hub.

A vertically extending cylindrical hollow post 14 is slide fitted at its lower end into the hub and secured therein against relative turning by means of a lock screw 15.

Levelers 16 depending from the four corners of the base, together with a central leveler 17 depending from the strap 13 are adjustable to obtain a level horizontal condition of the base and a vertical condition of the post. The leveler 17 provides an additional support to the central area of the base for the load to be borne by the base.

The post extends axially and freely through a vertical hollow column 18, which defines a central supporting element of the file member 7. The file member is designed for the storage of file data thereon; and it is adapted to be manually rotated about the post by users to bring before them any desired file.

Column 18 is mounted at its upper and bottom ends respectively on bearings 19, 20 press fitted onto opposite end portions of the post, whereby the file member 7 is rotatable about the post. A housing of the upper bearing has a peripheral shoulder 21 overlapping the upper end of the column; and a housing of the lower bearing has a peripheral shoulder 22 abutting the underside of the column, whereby the column is restrained against endwise movement relative to the post. Further, the inner race of the lower bearing rests upon a washer 23 seated atop the hub 12.

Column 18 of the file member is preferably hexagonal in form. In each of its side walls 24 is a vertical row of slots 25 spaced above one another. The number of slots may be varied, here two are provided. Anchored into the slots of each side wall and projecting radially from the wall is a broad faced upstanding vertical panel 26. Engagement of the panel with the column is provided by hooks 27 projecting from an inner edge of the panel. Each hook is slidably inserted into a complementary one of the slots 25 in such manner that the hook engages over a bottom edge of the slot. As so supported, the panel extends radially from the column. It is apparent that a panel may be easily removed from the column by lifting the panel slightly upward to clear the several hooks from the lower edges of the slots, and then withdrawing the panel free of the slots. Each panel in its engaged relation to the column is equally separated by an angular space 28 from the next panel.

Anchored in each space between the side walls of the panels defining the space is a plurality of horizontally disposed shelves 29 (FIGS. 2, 3, 4) spaced one above the other. Each shelf is a pie-form segment slidably entered into the space. The shelf is anchored to the side walls by tab means 31 depending from opposite sides of the shelf. Here, two tabs are shown on opposite sides of the shelf. The tabs are slidably hooked into complementary pockets 32 lanced into the side walls. The pockets are arranged in parallel vertical rows in each side wall of a panel (FIGS. 1, 2). The pockets in the rows are at the same level and are spaced one above the other, so that a shelf may be engaged as desired in complementary pockets at any selected level. And, a multiple number of shelves, spaced one above the other, may be positioned between each pair of opposed panels to the extent of the number of pockets.

So that the rows of pockets at one side of a panel will be duplicated at the opposite side of the panel, the panel comprises two sheets 33 welded face to face. The pockets formed in one of the sheets are duplicated in opposed relation to one another in the other sheet. The several panels engaged by the shelves, together with the central column 18 rotatably mounted to the post 14 defines the rotary file member 7.

A backwall 34 (FIGS. 5, 2) is provided for each shelf. Projecting from each of opposite sides of the backwall is a pair of tabs 35 slidably entered into complementary slots 36 (FIGS. 1, 2) formed in the opposed walls of the panels between which the shelf is received. In each of the opposed walls of the panels is a vertical row 37 of the slots 36. The slots are spaced above one another in such manner that a backwall may be selectively positioned at different levels to provide a backwall to any particular shelf.

The backwall is flexible. This enables it to be readily removed when it is desired to do so, or to be readily replaced and firmly held in place. To remove a backwall, it is manually flexed to withdraw its tabs from the panel slots so as to allow it to be removed. And, when a backwall is to be assembled at the rear of a shelf, it is manually flexed so as to permit it to be positioned between a pair of opposed panels and to bring its tabs into register with complementary slots. The flexing is then relaxed to allow the tabs to enter and be retained firmly in the slots.

Further, means is provided to enable a space 28 above a shelf to be divided into two or more narrower vertical compartments, so as to accomodate in each compartment a relatively limited number of documents. To this end, the backwall for each shelf is provided with a laterally extending row of vertical slots 38; and the shelf is provided with an arcuate row of radially extending slots 39 complementing the slots 38 in the backwall. Thin walled divider elements 41 (FIGS. 2, 6) are provided to divide the space above a shelf into radially extending vertical compartments. Each divider is formed with a tab 42 extending from its rear end; and is provided with another tab 43 depending from its forward end. A divider is adapted to be engaged with a shelf and a backwall at the rear of a shelf by first inserting its rear tab 42 into a selected slot 38 of the backwall. The divider is then slightly pressured against the flexible backwall to flex the latter sufficiently to register the depending tab 43 at the forward end of the divider with and to enter it down into a complementary slot 39 of the shelf slightly forward of a rear end of the slot. When the flexing pressure on the backwall is relaxed, the divider tabs entered into both the backwall and the shelf obtain a condition holding the divider rigidly in a vertical position.

It can be seen that, at the election of the user, the space above a shelf may be readily divided into vertical compartments of selective widths according to the slots selected to receive a divider. Also, the space may be divided into a multiple number of compartments according to the number of dividers that are assembled to the backwall and the shelf.

Further, the depth of any particular shelf may be selectively varied, so as to accomodate and provide easy access to documents of a particular length, such as letter or legal size. To this end, additional parallel vertical rows 44, 45 of slots 36 are provided in each panel; and complementary backwalls of proper widths are provided for engagement with the slots in each row, as at 34*a* in FIG. 2. Also, divider elements of complementary lengths, as at 41*a* in FIG. 2, are provided for engagement with complementary backwalls to provide compartments of selective widths and depths.

It is also apparent from the foregoing that the various components of the rotary file member 7 may be readily assembled to one another and firmly held in place without the need of nuts, bolts or other like fasteners. It is similarly apparent that the components of the rotary file unit 1 may be readily dissassembled when desired for relocation or for packaging in a compact bundle for shipment. When the unit is to be dissassembled, the backwalls and dividers are slidably removed from the related slots, and the shelves are slidably lifted from the associated pockets. The panels of the unit are then unhooked from the slots of the column. The post with the column mounted thereon is then slipped upwardly out of the hub of the base. The several components may then be put into a compact package for shipment, relocation or set aside for reassembly elsewhere.

Figure 8:
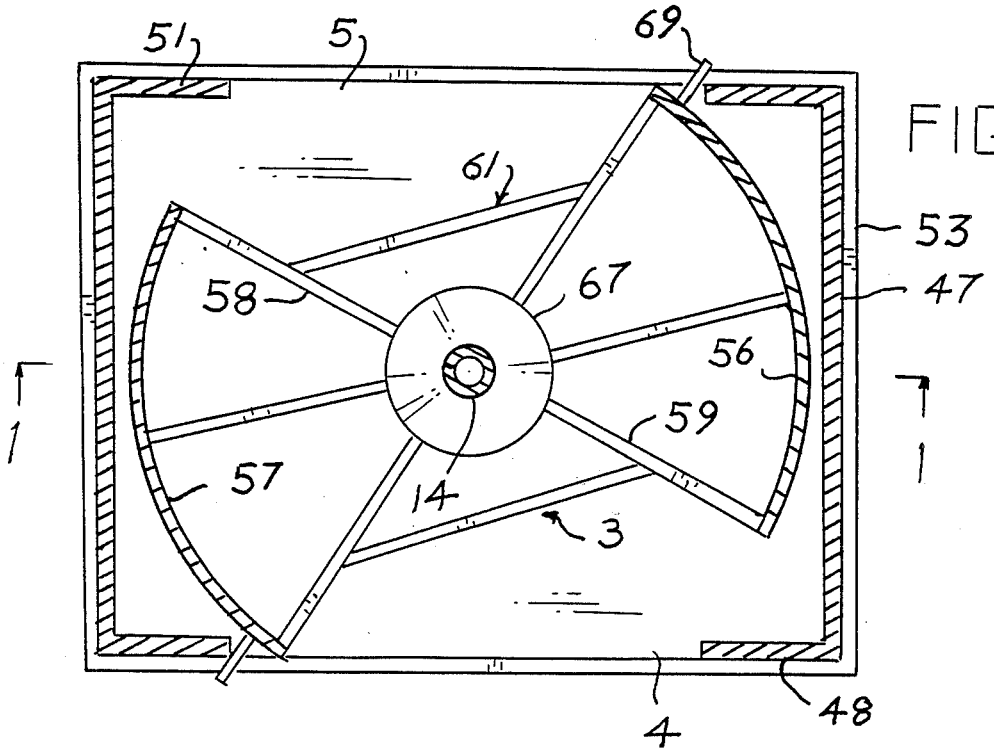
FIG. 8 is a section, on a smaller scale, on line 8—8 of FIG. 1.

As described above, the rotary file unit 1 may be used standing alone upon the base 6 apart from the cabinet 2. It may also be used as a component of the cabinet, as appears in FIGS. 1, 7 and 8, where the cabinet has a rotatable door unit 3 adapted to provide access to the file unit from opposite sides of the cabinet.

The cabinet has side walls 47 fastened to opposite sides 8 of the base 6. A pair of narrow walls 48, contiguous with the side walls, are fastened to a front side of the base and are spaced from each other by a front door opening 4; and a similar pair of walls 51 are fastened to a rear side of the base and are spaced from each other by a rear door opening 5. The door or access openings to the cabinet are directly opposite to each other. The upper ends of the several walls of the cabinet are fastened to a flange 53 depending from the sides of a cover or top wall 54 of the cabinet. A short tube 55 depending from the center of the top wall defines a cap which seats over an extended upper end of the post 14.

The rotatable door unit 3 comprises a pair of opposed curved panel doors 56, 57. The doors are mounted at their upper ends respectively to the ends of spokes 58, 59 of an upper spoked frame 61; and they are respectively mounted at their lower ends to the ends of spokes 62, 63 of a lower spoked frame 64. The lower spoked frame has a hub 65 to which the inner ends of its spokes are fixed, and which hub is supported by a thrust washer bearing 66 for rotation about the hub 12 of the base 6. The upper spoked frame has a hub 67 to which the inner ends of its spokes are fixed, and which hub is mounted for rotation about the post. The height of the door unit is such that the hub of the upper spoked frame is spaced above and clear of the upper end of the rotatable file member 7. And the lower end of the door unit rests upon a bearing spacer 68 seated upon the ribs 11 of the base member 6.

Each door has a curvature sufficient to close over a separate one of the access or door openings 4, 5 to the cabinet. This curvature is approximately 90°. It can be seen that upon rotating the door unit in one direction for approximately 90° the doors will close over both access openings, as in FIG. 7; and that upon rotating the door unit in the opposite direction the doors will clear the access openings, as in FIG. 8. A stop 69 projecting from an end of each door is cooperable with the walls of the cabinet adjacent a door opening to limit the extent of rotation of the door unit to open and closed positions.

A key operable security lock 71, having a part mounted to one of the doors and cooperable with a part mounted to a wall of the cabinet, is provided for locking the door unit in its closed condition when the file unit is not in use.

It is to be noted that the separate mountings to the post 14 of the rotatable file member 7 and the rotatable door unit 3 are such that the file member is rotatable about the post relative to and independently of the door unit; and that the door unit is rotatable about the post relative to and independently of the file member.

While an embodiment of the invention has been illustrated and described in detail, it is to be expressly understood that the invention is not limited thereto. Various changes of form, design or arrangement may be made in its components without departing from the spirit and scope of the invention. It is my intent, therefore, to claim the invention not only as shown and described but also in all such forms and modifications or equivalents thereof as might be construed to be within the spirit of the invention when considered in the light of the specification, the drawing and the appended claims.

What is claimed is:

1. A rotary file unit comprising a floor base, a stationary vertical post having a releasable mounting with the base, a hexagonal-faced vertical column disposed coaxially about the post and having a bearing mounting to the post enabling rotation of the column about the post, an upright panel extending radially from each face of the column, the panels being in equal angular spaced relation to one another, each panel having a slidably releasable hooked engagement with complementary slots in the column, a plurality of horizintally disposed shelves of pie-form spaced one above the other between each angularly opposed pair of panels, each shelf being provided with side tabs slidably engaged in complementary pockets formed in the opposed pair of panels, a separate backwall disposed rearwardly of each shelf and having a slidably releasable mounting between the opposed pair of panels, and vertically disposed thin walled divider means engaged by a releasable tab and slot connection with a backwall and further engaged by a releasable tab and slot connection with the related shelf, the divider means serving to divided the space above a shelf into radially extending compartments for reception therein of file papers.

2. A rotary file unit comprising a floor base, a stationary vertical post having a releasable mounting with the base, a hexagonal-faced vertical column disposed coaxially about the post and having a bearing mounting to the post enabling rotation of the column about the post, an upright panel extending radially from each face of the column, the panels being in equal angular spaced relation to one another, each panel having a slidably releasable hooked engagement with complementary slots in the column, and a plurality of horizontally disposed shelves of pie-form spaced one above the other between each angularly opposed pair of panels, the space above each shelf defining a radially extending compartment for reception therein of file papers.

3. A rotary file unit as in claim 2, wherein the rotary file unit is disposed within a cabinet; the cabinet is of quadrate form having a pair of walls closing over opposite sides of the cabinet, a pair of laterally spaced narrow walls at the front of the cabinet defining between them a front access opening to the cabinet and a pair of laterally spaced narrow walls at the rear of the cabinet defining between them an opposed rear access opening to the cabinet; the cabinet has a top wall provided with a depending cap seated upon an upwardly extended end of the post; and the access openings provide access to the rotary file unit from opposite sides of the cabinet; and wherein a rotary double door unit is disposed within the cabinet in surrounding relation to the rotary file unit and has a bearing mounting to the post enabling rotation of the door unit about the post relative to the rotary file unit; and the door unit being adapted when rotated in one direction to close its doors over both access openings and to carry its doors clear of both access openings when rotated in a reverse direction.

* * * * *